US006142651A

United States Patent [19]

Thompson

[11] Patent Number: 6,142,651

[45] Date of Patent: Nov. 7, 2000

[54] LAMP REFLECTOR

[76] Inventor: Wade Thompson, 449 Kingshead Ct., Irmo, S.C. 29063

[21] Appl. No.: 09/135,776

[22] Filed: Aug. 18, 1998

[51] Int. Cl.[7] ..... F21K 7/00

[52] U.S. Cl. ..... 362/263; 362/360; 362/361; 362/407; 362/408

[58] Field of Search ..... 362/217, 263, 362/261, 264, 407, 408, 359, 360, 361; 313/215

[56] References Cited

U.S. PATENT DOCUMENTS

| | | | |
|---|---|---|---|
| 3,057,994 | 10/1962 | Irmischer | 248/276.1 |
| 3,334,222 | 8/1967 | Ziegler et al. | 362/355 |
| 3,374,343 | 3/1968 | Bobrick . | |
| 3,388,249 | 6/1968 | Siegel et al. | 362/345 |
| 3,752,975 | 8/1973 | Meyer | 116/173 |
| 4,231,080 | 10/1980 | Compton | 362/346 |
| 4,418,379 | 11/1983 | De Marsh | 362/282 |
| 4,591,960 | 5/1986 | Jones | 362/302 |
| 4,731,714 | 3/1988 | Kelly et al. | 362/147 |
| 4,856,103 | 8/1989 | Compton | 362/308 |
| 4,864,476 | 9/1989 | Lemons et al. | 362/297 |
| 4,969,074 | 11/1990 | Davis et al. | 362/334 |
| 4,987,524 | 1/1991 | Miller | 362/356 |
| 5,016,150 | 5/1991 | Gordin et al. | 362/263 |
| 5,329,438 | 7/1994 | Thompson | 362/296 |
| 5,363,293 | 11/1994 | Lasker | 362/261 |
| 5,381,325 | 1/1995 | Messana | 348/208 |
| 5,575,550 | 11/1996 | Appeldorn et al. | 40/547 |
| 5,730,521 | 3/1998 | Spink et al. | 362/217 |

FOREIGN PATENT DOCUMENTS

| | | | |
|---|---|---|---|
| 71124 | 8/1915 | Switzerland | 362/296 |

*Primary Examiner*—Sandra O'Shea
*Assistant Examiner*—Bertrand Zeade
*Attorney, Agent, or Firm*—Michael A Mann; Nexsen Pruet Jacobs & Pollard LLP

[57] ABSTRACT

A lighting system comprising a reflector and an arc lamp designed for illuminating a wide area with an even light distribution. The reflector has a cap portion integrally joined to a visor portion. The cap portion is generally parabolic in shape except perhaps at its center. The visor flares outwardly at a low angle and is about three to six inches long, dropping approximately one-half inch so that it is no higher than the bottom of the arc tube of the lamp. The arc lamp is preferably a high intensity sodium or mercury vapor lamp with a vertical arc tube mounted so that about one-half inch of arc tube extends below the juncture of the visor and the cap.

20 Claims, 4 Drawing Sheets

LAMP REFLECTOR

1. FIELD OF THE INVENTION

The present invention relates to outdoor or high bay illumination. In particular, the present invention relates to reflectors used with high intensity arc lamps.

2. BACKGROUND OF THE INVENTION

Lamps send out light in all directions. Without a shade or reflector, this light is only blocked by the base of the lamp. In order to make better use of this light, the lamps are used with reflectors and lenses. The reflectors reflect light emanating from one side of the lamp to another direction, and lenses refract the light so that it traveling in a different and preferred direction when it passes from a lens than when it entered the lens.

Light is a form of energy and should therefore be conserved and not wasted. Light can also become a form of pollution if it is directed where it is interferes with other activities, such as when light intended to illuminate the ground is partially directed into the sky only to obscure the stars. Control of a light beam is therefore important for three reasons, (1) light should be directed where it is needed so that it does what it is intended to do: illuminate an area for example; (2) it should not be wasted by directing it where it serves no purpose; and (3) it should not be directed where it interferes with other activities.

Controlling light from lamps is not as simple as it might sound. Especially when using lamps to illuminate large areas of ground outside at night. The goal of outdoor illumination, generally speaking, is to spread light from a simple lamp over as wide an area as possible and as evenly as possible but not to allow any light to be directed upwardly.

For example, see the lighting optical system of Jones as described in U.S. Pat. No. 4,591,960 which is intended to uniformly illuminate a large area using multiple reflectors. FIG. 3 of Jones shows a candle power distribution curve achieved by his system. This type of curve is commonly used to compare the efficiencies of lighting systems.

Often light is directed upwardly at an object in such a way that little of the light actually reaches the object and much is directed into the sky where it serves no purpose or blocks the view of the stars. An example of this is illumination of flags. Meyer in U.S. Pat. No. 3,752,975 teaches a light at the top of a flag pole for illuminating the flag from above rather than below but his light does not provide the lateral range for illuminating an unfurled flag.

Parabolic reflectors are well known in illuminating systems, especially those where the light is to be directed downwardly. Parabolic reflectors by definition tend to keep light rays parallel when the lamp located at the focus of the parabola so that a parabolic reflector does not disperse light but does illuminate a small area. If the parabola is directed downwards and its edge is extended below the focus of the parabola and the lamp, it will cutoff any upward light. See for example, the device described by Thompson in U.S. Pat. No. 5,329,438.

Many lights use visors or reflectors that are less vertical than that shown in Thompson's device to allow some spread of the light in a horizontal direction.

Nonetheless, there remains a need for a reflector that better achieves the goal of an even, downward-only, wide-spread light pattern, especially for use outdoors and in high bays.

SUMMARY OF THE INVENTION

According to its major aspects and broadly stated, the present invention is a reflector having a parabolic cap in combination with a shallow angled visor and a high intensity discharge lamp, in particular one with a vertical arc tube, placed near the point where the cap and visor meet. By forming a reflector having this shape and placing a lamp at the designated location, the distribution of light from the lamp is extraordinarily even and wide and no light is directed upwardly.

The parabolic shape is one where the first portion of the cap, as measured from its center, may initially be flat but its shape is otherwise parabolic. The visor connects with, and is preferably integral with, the cap but flares outwardly from the cap's edge at a small angle. The bottom of the arc tube should be no lower that the bottom of the visor. Preferably where the edge of the cap meets the visor should be approximately one half inch from the bottom of the arc tube.

A feature of the present invention is the combination of the position of the lamp with respect to the reflector and the reflector's shape. Because of this physical relationship, no light will be directed upwardly and much of the light will be directed laterally. The present reflector and lamp illuminate as wide an area as current prismatic lensed lamps with high efficiency but send no light upward; prismatic lamps send as much as 30%–35% of their light upward. Furthermore, there are no lenses to clean.

Another feature of the invention is the use of a parabolic cap. By making the majority of the cap parabolic, light striking the inside of the cap toward its edge is reflected laterally to a greater extent than if the cap were a different shape.

Still another feature of the present invention is the use of a visor in combination with the parabolic cap and a vertically mounted arc lamp. The two in combination assure that much of the light that is emitted from the sides of the arc lamp is reflected laterally either by low angle reflectance by the visor or high angle reflectance by the cap. The relatively sharp transition from cap to visor minimizes the portion of the light that is reflected in a more downward direction than laterally.

Other features and advantages of the present invention will be apparent to those skilled in the art from a careful reading of the Detailed Description of a Preferred Embodiment presented below and accompanied by the drawings.

DETAILED DESCRIPTION OF A PREFERRED EMBODIMENT

Referring now to the figures, the present invention is a lamp and reflector combination for uniformly illuminating a wide area. The lamp may be any source of light including an incandescent light. However, most preferably, the lamp is a high intensity, high pressure sodium or mercury vapor, vertical lamp of 70–175 watts with an arc tube. These lamps throw most of their light to the side so, when oriented vertically, will illuminate a wide area.

Figure 1:
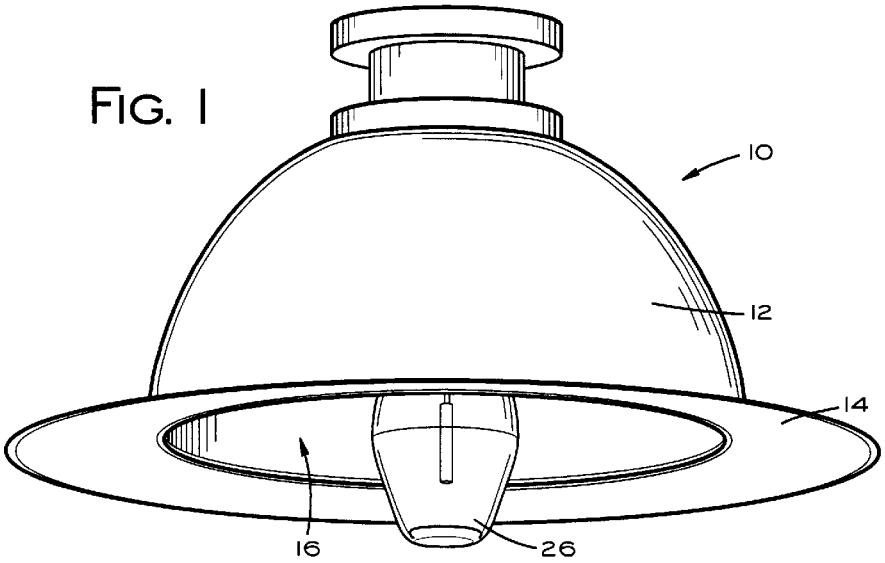
FIG. 1 is a perspective view of a reflector according to a preferred embodiment of the present invention.

The reflector, generally indicated in the figures by reference number 10, has a cap portion 12 and a visor portion 14 that are preferably integral, made of a reasonably rigid material that is opaque to the light of the lamp and its interior surface 16 is highly reflective of all wavelengths of visible light emitted by the lamp. For example, the reflector may be made of metal, glass or plastic and finished on its interior with a bright white or chrome finish or may be polished to a mirror-like condition. If the lamp is mounted from the bottom, the top of cap portion is closed; if the lamp is mounted from the top, as seen in FIG. 1, the top portion of cap portion is open.

The shape of cap 12 is defined in relation to its centerline 18. Beginning at its center 20 and moving radially outwardly from centerline 18, cap portion 12 is initially nearly flat or parabolic. It quickly begins to follow a parabolic shape until it reaches a junction 22 between cap portion 12 and visor portion 14 of cap 12. This shape will be referred to for convenience herein as a parabolic although the first portion of it may not be parabolic.

At junction 22, reflector 10 turns radially outwardly to form visor 14. Visor 14 is flat and oriented at a low angle 24. The extent of visor 14 depends on angle 24 and the position of lamp 26 mounted in it, as will be explained below. The bottom of visor 14 should be no higher than the bottom of arc tube 28. Angle 24 should be as small as practical and visor 14 must have a reasonably size such as three to six inches and will drop from juncture 22 by approximately one-half inch.

Figure 2:
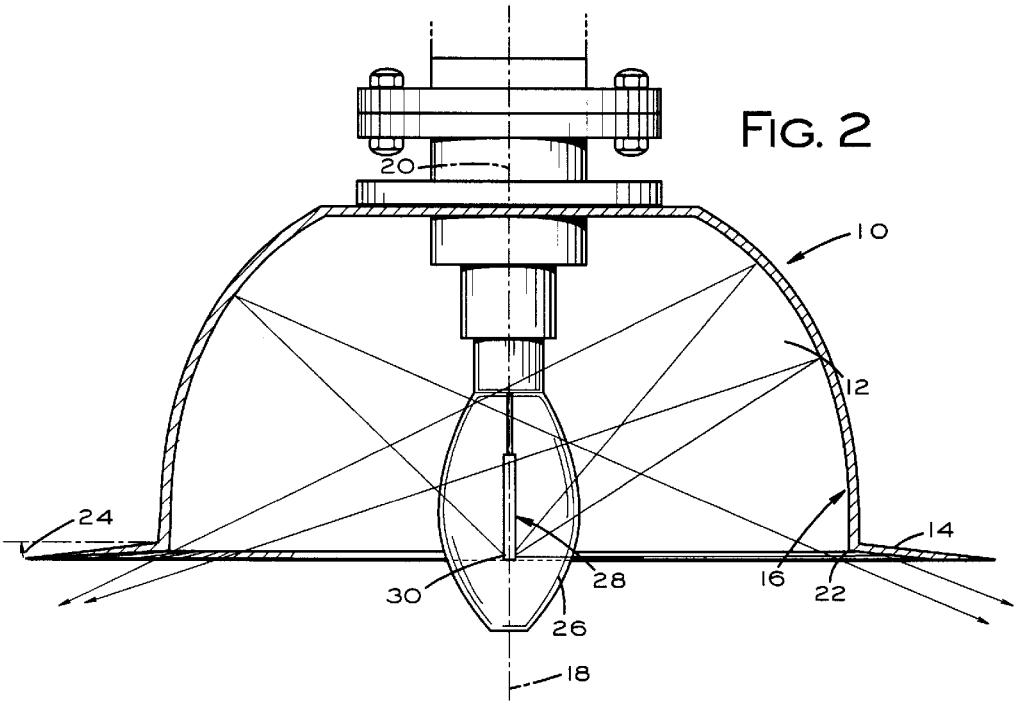
FIG. 2 is a cross sectional view of the reflector of FIG. 1.

Lamp 26 has an arc tube 28 mounted in it. Arc tube 28 has a length and a midpoint 30. Preferably, midpoint 30 is oriented so that it is even with the juncture 22 of cap 12 and visor 14; alternatively, no more than one-half inch of an arc tube 28 should extend below juncture 22. Any light from the upper half of arc tube 28 that is emitted by lamp 26 radially is cutoff by cap 12 and reflected ultimately downwardly and radially outwardly by cap 12. Any light from the lower half of arc tube 28 that is emitted by lamp radially is reflected downwardly and radially outwardly by visor 14 as shown in FIG. 2 by three light rays, one reflected essentially down, and one radially by cap 12 and one radially by visor 14.

Figure 3:
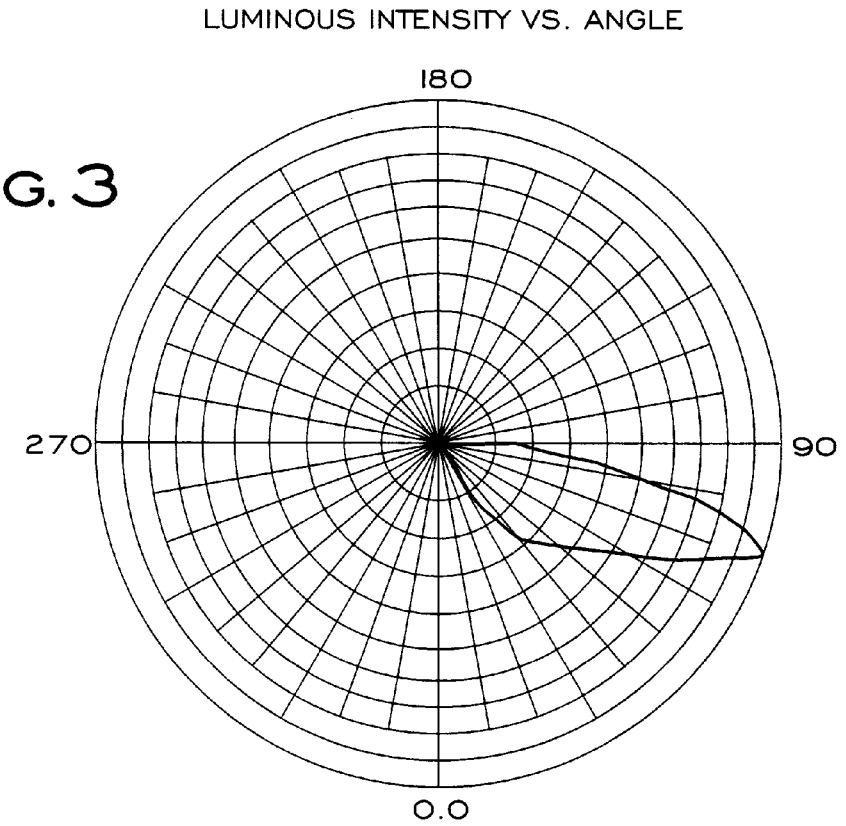
FIG. 3 is a candle power distribution curve for the present invention.

If one-half inch of arc tube 28 extends below juncture 22, then brim is preferably approximately 4½ inches in length. The lowermost part of arc tube 28 should not extend below visor 14. With a lamp and reflector according to the present invention and dimensions, a candle power distribution pattern such as that shown in FIG. 3 is obtained which illustrates a high efficiency of 86% or more.

A significant part of how this reflector works is that the arc tube is mounted low in the reflector so that all of the light from the bottom half inch of arc tube 28, which reflects off of cap 12, is reflected above the normal to send light out horizontally. There is a gradual change in the light reflections off the upper portion of cap 12 coming from arc tube 28. Regardless of the size of the lamp 26 used, the bottom half inch of its arc tube 28 would reflect light off the interior of cap 12 above the normal to that interior surface. The balance of arc tube 28 would reflect light off cap 12 below the normal as with current reflectors. Thus it makes no difference how long arc tube 28 is as long as the bottom of it is lined up with the bottom of visor 14 and approximately one-half inch of arc tube 28 is below cap 12.

Figure 4:
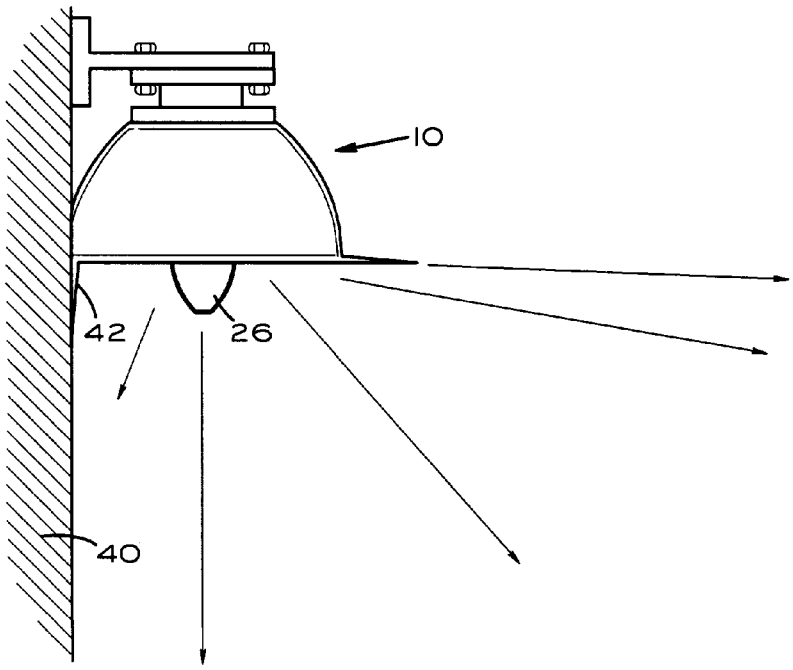
FIG. 4 is a perspective view of an alternative embodiment of the present invention.

In an alternative embodiment shown in FIG. 4, a side of visor 14 is bent to form a fold 40 to reflect a portion of the light so that is redirected to the opposing side of lamp. This configuration would be used when reflector 10 is mounted to a wall 42. If mounted to a wall in a corner, reflector 10's visor 14 would have two folds meeting at right angles.

Figure 5A:
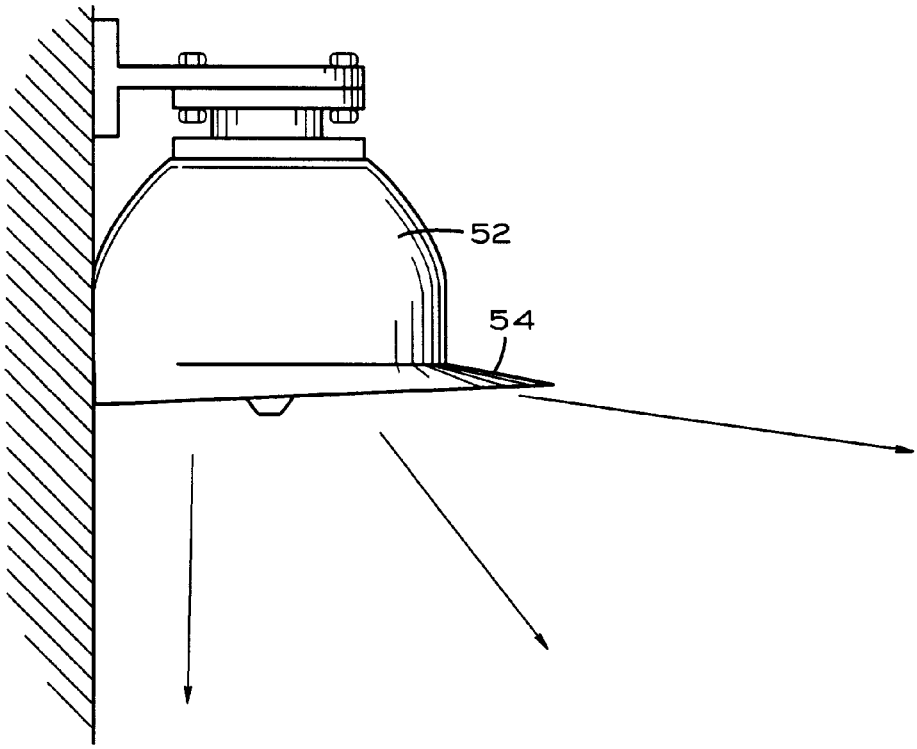
FIG. 5A and 5B are top and side views, respectively of still another alternative embodiment of the present invention.
Figure 5B:
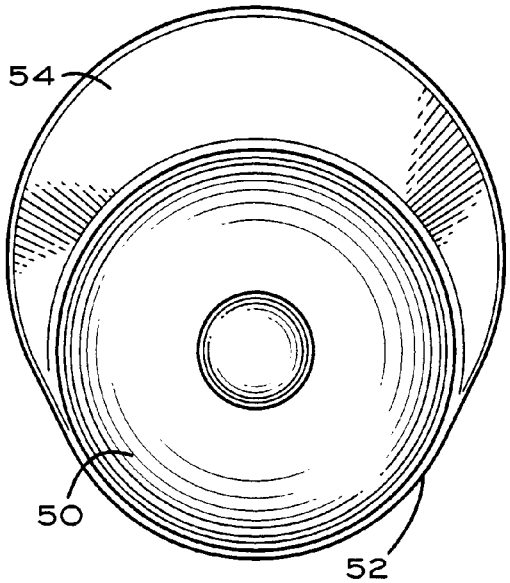

For use on a pole near a comer but not wall mounted, FIG. 5A and 5B illustrate another embodiment of the present invention. A reflector 50 has a cap 52 and a visor 54 that extends outwardly as described above over a portion of the circumference of cap 52 but curves downwardly until, at the rearmost portion of the circumference, visor 54 is a continuation of cap 50's parabolic shape.

Figure 6:
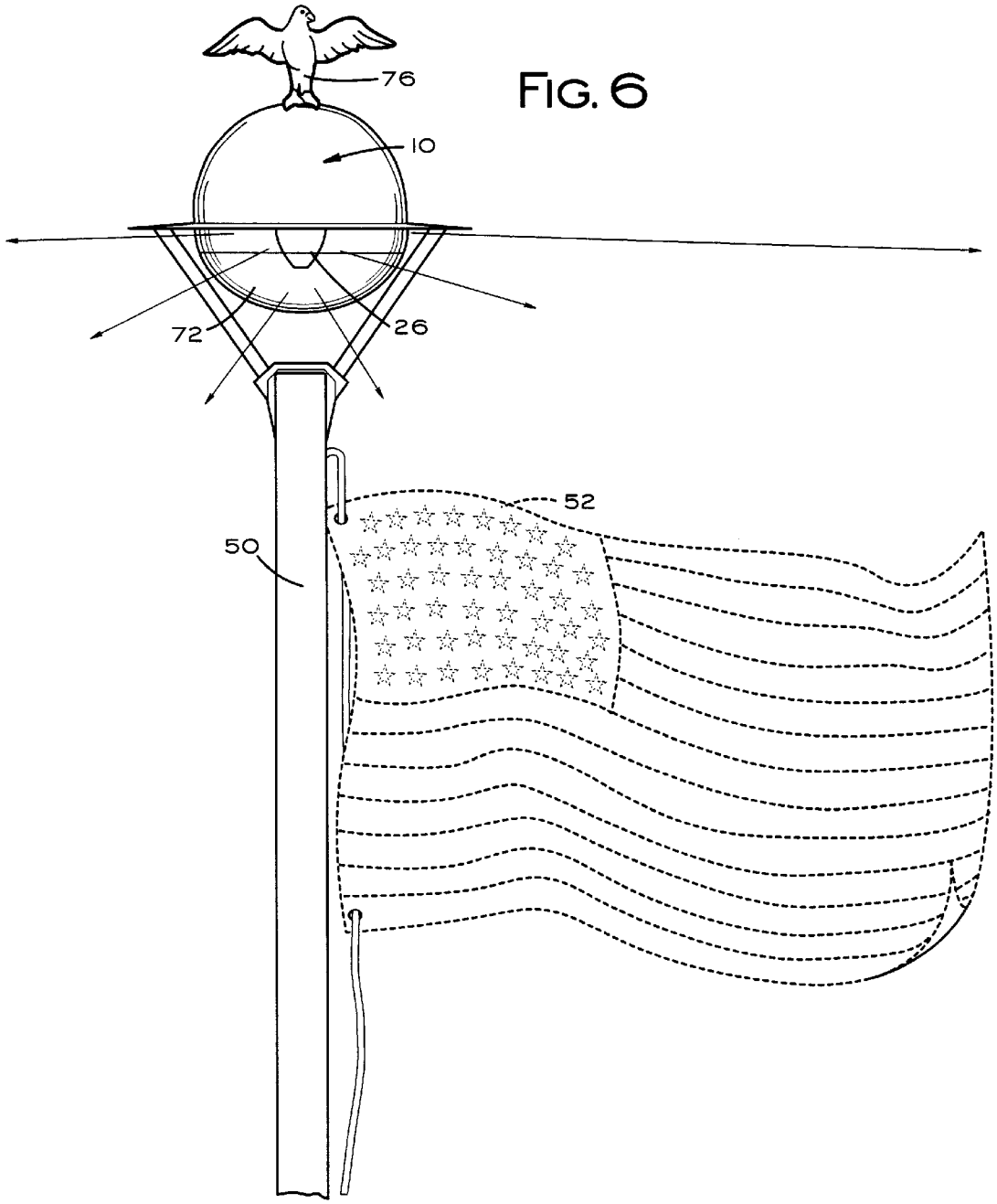
FIG. 6 is a perspective view of still another alternative embodiment of the present invention.

In still another alternative embodiment of the present invention shown in FIG. 6, a reflector 10 and lamp 26 according to the present invention are mounted to the top of a flagpole 50 to illuminate an unfurled flag 52, with no wasted light. An optional transparent cover 72 may be placed over lamp 26 and preferably, ornamentation, such as an eagle 76 may be placed on top of reflector 10.

Other lighting products embodying the present invention are also possible.

It will be apparent to those skilled in the art that many changes and substitutions can be made to the preferred embodiment herein described without departing from the spirit and scope of the present invention as defined by the appended claims.

What is claimed is:

1. A device for illuminating an area, said device comprising:

a reflector having
a cap portion, and
a visor portion, said cap portion meeting said visor portion at a juncture; and a lamp having an arc tube and mounted within said reflector so that the lowermost part of said arc tube is no lower than the lowermost part of said visor and approximately one-half inch of said arc tube extends below said juncture.

2. The device as recited in claim 1, wherein said cap portion is generally parabolic in shape.

3. The device as recited in claim 1, wherein said arc tube is mounted vertically in said reflector.

4. The device as recited in claim 1, wherein said cap and said visor are integrally formed.

5. The device as recited in claim 1, wherein said visor is between three and six inches long.

6. The device as recited in claim 1, wherein said reflector has an interior surface that reflects visible light.

7. The device as recited in claim 1, wherein said lamp is selected from the group consisting of high pressure sodium lamps and mercury vapor lamps.

8. A device for illuminating an area, said device comprising:

a reflector having
a cap portion, and
a visor portion, said cap portion being generally parabolic in shape and meeting said visor portion at a juncture and said visor being between three and six inches in length and dropping approximately one-half inch from said juncture; and a lamp mounted within said reflector and having an arc tube.

9. The device as recited in claim 8, wherein said cap and said visor are integrally joined.

10. The device as recited in claim 8, wherein said lamp is selected from the group consisting of high pressure sodium lamps and mercury vapor lamps.

11. The device as recited in claim 8, wherein said arc tube is mounted vertically.

12. The device as recited in claim 8, wherein said arc tube is mounted so that its midpoint is even with said juncture.

13. The device as recited in claim 8, wherein said arc tube is at least one inch in length and said arc tube is mounted within said reflector so that its lowermost end is no lower than said visor.

14. The device as recited in claim 8, wherein said cap is flat in the center and parabolic radially outward of the center.

15. A device for illuminating an area, said device comprising:

a reflector having
a cap portion, and
a visor portion,
said cap portion meeting said visor portion at a juncture and said visor dropping approximately from said juncture; and
a lamp mounted within said reflector so that its lowermost portion is not below said visor portion, said lamp having an arc tube.

16. The device as recited in claim 15, wherein said cap portion is generally parabolic in shape but is flat at its center.

17. The device as recited in claim 15, wherein said visor portion extends approximately three to six inches from said juncture.

18. The device as recited in claim 15, wherein said arc tube is mounted to said reflector vertically.

19. The device as recited in claim 15, wherein said lamp is selected from the group consisting of high pressure sodium lamps and mercury vapor lamps.

20. The device as recited in claim 15, wherein approximately one-half inch of said arc tube extends below said juncture.

* * * * *